United States Patent [19]

Singh et al.

[11] Patent Number: 4,793,413

[45] Date of Patent: Dec. 27, 1988

[54] METHOD FOR DETERMINING FORMATION PARTING PRESSURE

[75] Inventors: Pramod K Singh; Ram G. Agarwal, both of Tulsa, Okla.; Charles W. Miller, Levelland, Tex.

[73] Assignee: Amoco Corporation, Chicago, Ill.

[21] Appl. No.: 135,873

[22] Filed: Dec. 21, 1987

[51] Int. Cl.[4] ..... E21B 43/26; E21B 47/06

[52] U.S. Cl. ..... 166/250; 116/308

[58] Field of Search ..... 166/250, 308; 73/155

[56] References Cited

U.S. PATENT DOCUMENTS

| | | | |
|---|---|---|---|
| 4,372,380 | 2/1983 | Smith et al. | 166/250 |
| 4,393,933 | 7/1983 | Nolte et al. | 166/250 |
| 4,434,848 | 3/1984 | Smith | 166/308 X |
| 4,442,895 | 4/1984 | Lagus et al. | 166/308 X |
| 4,453,595 | 6/1984 | Lagus et al. | 166/308 |
| 4,577,689 | 3/1986 | Dotson | 166/250 |

OTHER PUBLICATIONS

Agarwal, "A New Method to Account for Producing Time Effects When Drawdown Type Curves Are Used to Analyze pressure Buildup and other Test Data," SPE paper No. 9289, Society of Petroleum Engineers of AIME, Sep. 1980, Dallas TX, 20 pages.

Singh, et al., "Systematic Design and Analysis of Step--Rate Tests to Determine Parting Pressure," SPE paper No. 16798, Society of Petroleum Engineers of AIME, Sep. 27-30, 1987, Dallas, Texas, pp. 491-503.

*Primary Examiner*—Stephen J. Novosad

*Attorney, Agent, or Firm*—Scott H. Brown; F. E. Hook

[57] ABSTRACT

Fluid is injected into a wellbore at a first rate which is low enough to maintain formation pressure beneath formation parting pressure. Thereafter, the rate of fluid injection is increased to a second rate which is high enough to exceed formation parting pressure. The time and pressure data obtained during the first and second periods are normalized, plots thereof are superposed and the formation parting pressure is determined by noting the point at which the plots deviate from one another.

17 Claims, 10 Drawing Sheets

METHOD FOR DETERMINING FORMATION PARTING PRESSURE

BACKGROUND OF THE INVENTION 1. Field of the Invention

The present invention relates to methods for determining the formation parting or fracture parting or propagation pressure of an underground formation and more particularly to such a method in which fluids are injected into a wellbore. 2. Setting of the Invention As hydrocarbons are produced from a formation, the pressure in the formation gradually drops thus diminishing the rate of production. At some point it becomes economically justifiable to adopt enhanced recovery techniques in order to produce additional oil and gas from the formation. One widely applied technique involves injection of water and/or gas into the reservoir. Wells which are no longer producing may be used to inject water via pumps into a formation or new injection wells may be drilled. As water is injected, it moves through the reservoir displacing oil to producing wells.

In the case of certain types of wells, adjacent injection wells can be used to inject a gas, such as carbon dioxide, into the formation thereby driving hydrocarbons toward the producing well.

When injecting a fluid into a well to enhance recovery of an adjacent producing well, it is desirable to maintain the injection pressure below the pressure at which the formation parts or fractures. As fluid is injected into a well, the pressure in the formation surrounding the well increases until at some point the formation parts thereby establishing or opening a pre-existent fluid flow channel. Injected fluid flows into the channel and may be dispersed in the formation in a manner which decreases the effect of the injected fluid on the producing well. Even worse, an uncontrolled fracture might communicate with the producing wellbore, thereby forming a "pipeline" directly between the injecting well and the producing well. Thus, it is desirable to inject fluid into an injection well at a rate which maintains the pressure in the formation below the parting pressure.

It should be noted that some injection wells may include a fracture which is propped open. In such a case, fluid is injected into the well to fracture the formation. Thereafter, a propping agent is placed in the well to fill the fracture and maintain it in an open condition. When such a well is used as an injection well, it is desirable to inject fluid at a rate which prevents extension of the existing fracture in order to avoid any detrimental effect of fluid injection on the adjacent producing well or wells.

As can be seen from the foregoing, it is desirable to know at what pressure a particular formation will fracture. There exists a prior art method for determining formation parting pressure. In the prior art method, fluid is injected into the wellbore using a series of constant injection rates. The injection rate is increased from low to high in a stepwise fashion with the rate at each step being maintained at a constant level. It is also assumed that a steady state or a pseudo steady-state condition is achieved during each injection step. This may require that each step is continued ranging from a few hours to several tens of hours. The injection rates and the resulting injection pressures are measured during the test. The parting pressure can be determined from a plot of pressure at the end of each injection step against the corresponding rate for that step. Ideally, the plot exhibits straight line behavior below parting pressure and a reduced slope when parting pressure is exceeded. The pressure where this change in slope occurs is identified as the formation parting pressure. It can be seen that the accuracy of this test increases with the number of steps. In order to obtain a reasonably accurate indication of formation parting pressure, a series of several steps, each of which consists of a substantially different constant injection rate and a constant but long injection time period, is considered necessary.

In running the prior art test, it may be necessary to substantially disrupt injection well operations. In other words, the injection well to be tested may be injecting at a selected rate in order to increase recovery from adjacent producing wells. If so, the well may have to be shut-in or the rate may have to be substantially lowered in order to perform the prior art test. Injection operations cannot be resumed until after the several step test is performed.

There exists a need for a method for determining formation parting pressure which can be accomplished in a shorter time than prior art methods.

Moreover, there exists a need for such a test which can be performed quickly on an injection well which is injecting fluid into the formation.

SUMMARY OF THE INVENTION

The instant invention comprises a method for determining the parting pressure of a formation having a wellbore therethrough. Fluid is injected into the wellbore at a first rate for a first period of time. The rate of injection is changed to a second rate, which causes the formation pressure to rise above the formation parting pressure during a second step. Fluid injection is maintained at the second rate for a second period of time. The pressures in the wellbore during the first and second periods are measured. The pressure data obtained is normalized and the formation parting pressure is determined by locating the point at which the normalized data for the second time period deviate from the normalized data for the first time period.

DETAILED DESCRIPTION OF THE PREFERRED MODES OF CARRYING OUT THE INVENTION

The present invention provides a method for determining formation parting pressure. In one aspect of the invention, well rate and pressure are stabilized and thereafter fluid is injected for a first period of time at a first rate and then for a second period of time at a second rate. Well pressures are measured during the first and second time periods and the data so obtained is normalized. The data from the first and second time periods are superposed and the parting pressure is identified as the pressure at which the data from the two time periods deviate from one another.

Figure 1:
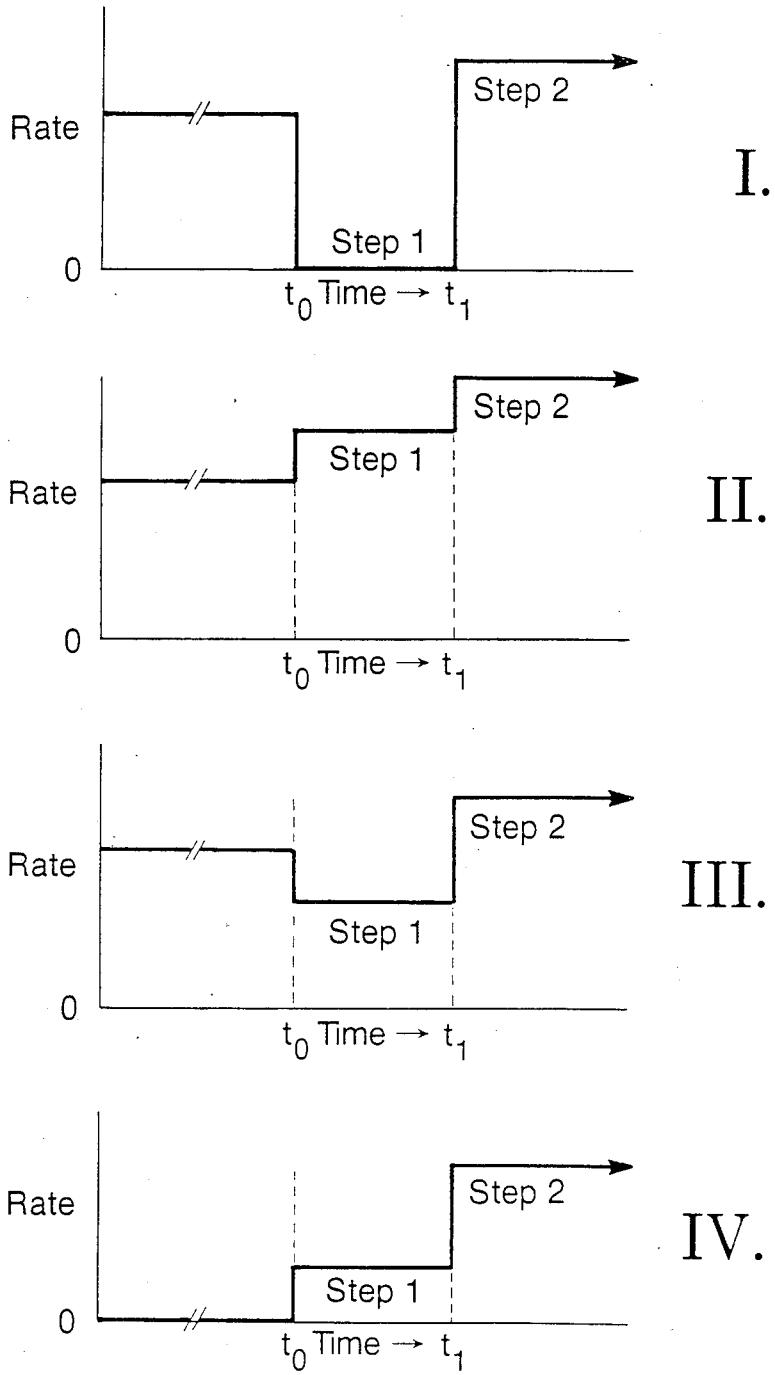
FIG. 1 is four rate vs time plots of the four modes of the present invention.

Before a detailed description of how the present invention is accomplished, it should be understood that the present invention can be accomplished in at least four different modes. As shown in FIG. 1, Mode I is where in Step 1 the well is shut-in, i.e., no injection, and in Step 2 the injection is started again at a rate usually higher than the beginning rate. Mode II is where in Step 1 the injection rate is increased and in Step 2 the injection rate is further increased. Mode III is where in Step 1 the injection rate is decreased and in Step 2 the injection rate is increased to a level higher than the beginning rate. Mode IV is where there is no injection until after Step 1 and in Step 2 the injection rate is further increased.

Consideration will now be given to the manner in which the instant invention can be used to determine the parting pressure or the pressure at which the fracture in a previously fractured injection well extends. At the outset, the pressure in the formation is stabilized either by shutting in the well, i.e., injecting no fluid into the well and stabilizing the well at formation pressure (Mode IV), or by injecting fluid into the wellbore at a substantially constant rate of injection for a time sufficient to stabilize formation pressure (Modes I, II or III). With respect to the example under consideration in FIG. 2A, water injection into the well has been undertaken at a substantially constant rate of 200 barrels per day for 14 days. It should be noted that a stabilized rate or formation pressure period is not considered a part of the test, but can have been set up as a part of the normal operation of the injection well. Note that the pressure is substantially stabilized at $t_0$.

Figures 2A, 2B:
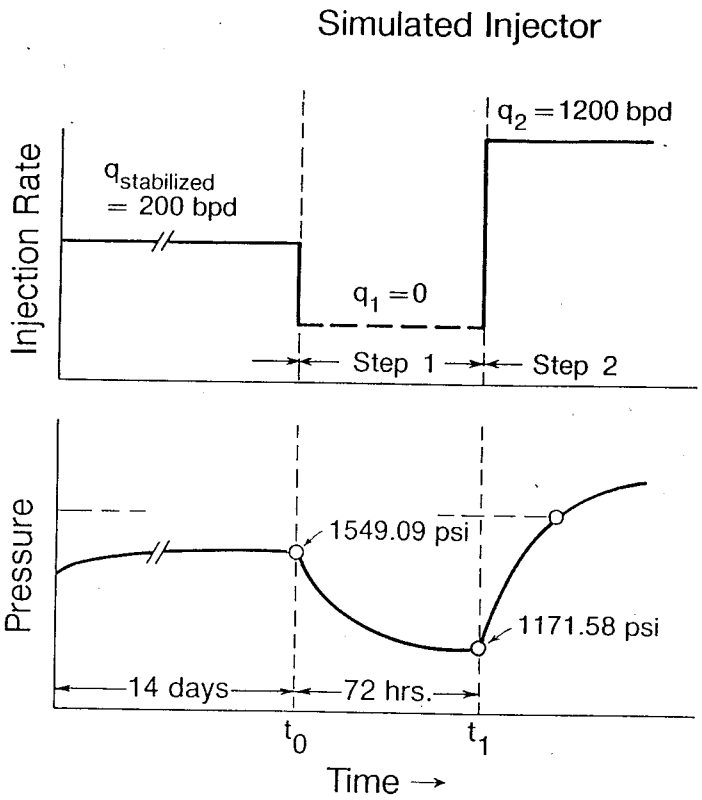
FIG. 2A is a plot of water injection rate vs time utilizing simulated data in Mode I.
FIG. 2B is a plot of pressure vs time utilizing simulated data in Mode I.

At $t_0$ the rate of water injection is changed. In the example of FIG. 2A, the well is shut-in, i.e., rate of injection equals zero. As used herein, a rate of fluid injection can refer to shutting in the well, i.e., the rate of injection is zero. The time between $t_0$ and $t_1$ in FIGS. 2A and 2B, is referred to herein as a first time period (Step 1). The time subsequent to $t_1$ is referred to herein as a second time period (Step 2). In the example of FIGS. 2A–2B, the first time period is equal to 72 hours. At $t_1$ the rate of injection is changed to a second rate, namely 1200 barrels per day, which is a rate sufficient to cause formation pressure to rise above parting pressure.

The pressure in the wellbore can be measured using a commercially available sensor during the flow rates shown in FIG. 2A to produce the pressure plot in FIG. 2B. It can be seen that when the injection rate changes from the pressure-stabilized value at $t_0$ to zero, i.e., when the well is shut-in, a pressure fall-off occurs and that when the flow is again increased to a second flow rate in the second time period, the pressure increases.

Figure 2C:
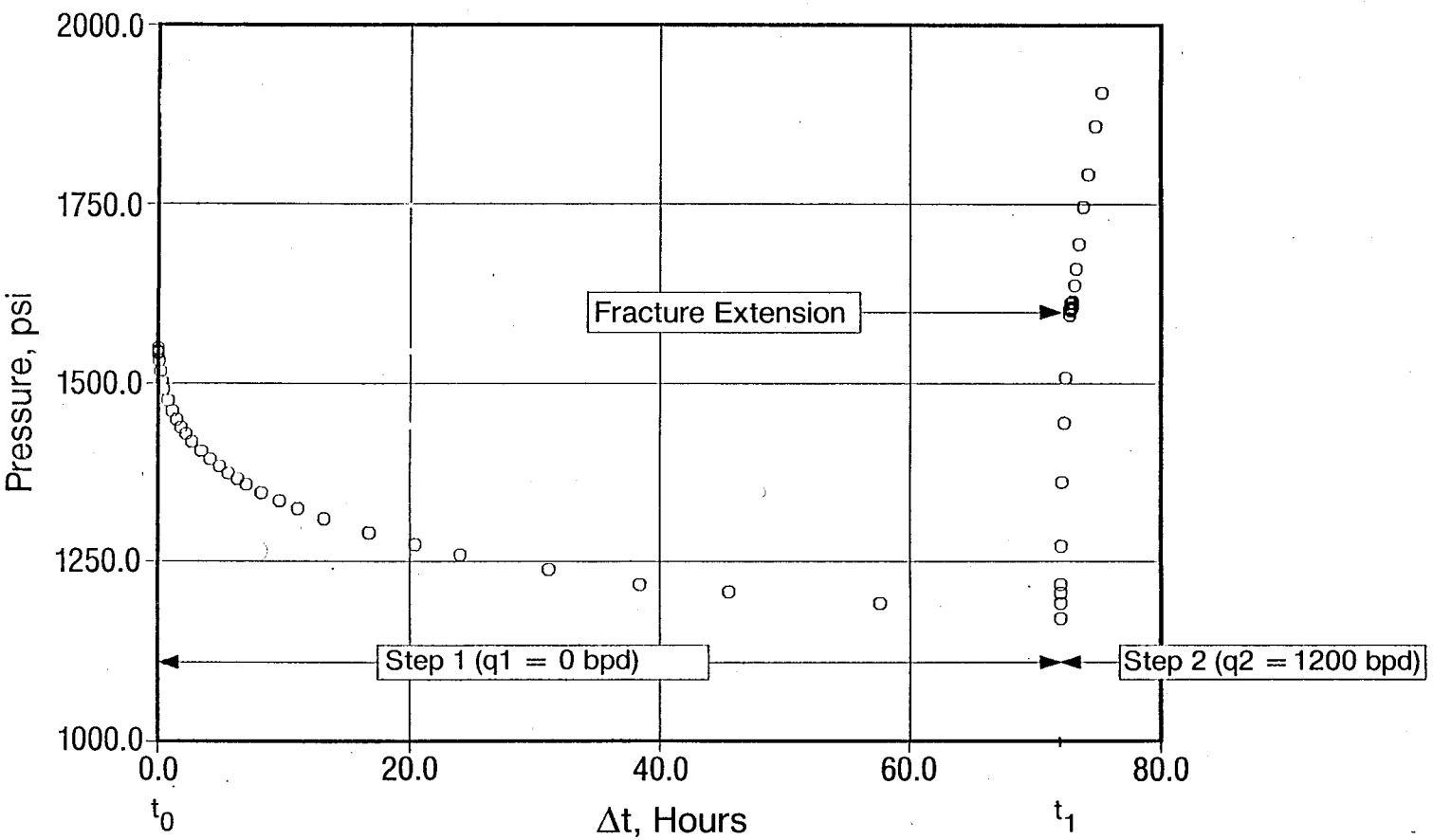
FIG. 2C is an enlarged portion of the plot of FIG. 2B. In these figures, $t_0$ and $t_1$ correspond to the beginning of test times for Step 1 and Step 2, respectively.

Table I includes data from which the plots of FIGS. 2A–2D are generated. For example, FIG. 2C is an expanded view of each of the sampled pressures which were measured during Steps 1 and 2. It can be seen in column 1 of Table I, the measuring point is related to a time at which the measurement was taken and the value of the measured pressure. Thus, FIG. 2C is a plot of the pressure vs time data in Table I.

Figure 2D:
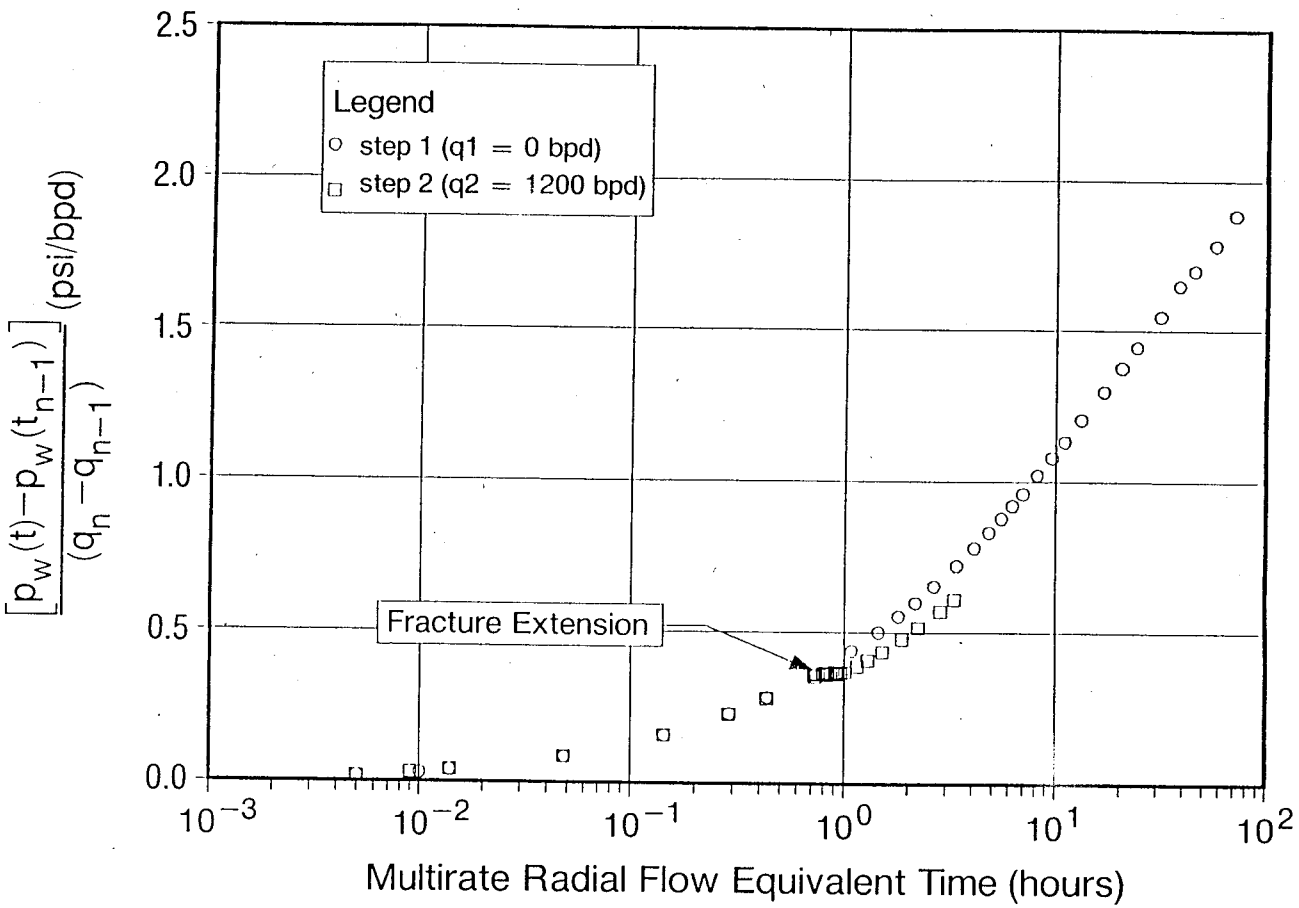
FIG. 2D is a superposed plot of the pressure and time functions for the first and second injection periods utilizing simulated data in Mode I.

Illustrated in FIG. 2D is a plot of normalized pressure vs time for Step 1 (shown in circles) superposed over a normalized pressure vs time plot for Step 2 (shown in squares). As noted in FIG. 2D, a value plotted along the vertical axis is obtained by the following equation:

$$\frac{P_w(t) - P_w(t_{n-1})}{q_n - q_{n-1}} \quad (1)$$

In the above equation, $P_{w(t)}$ is the measured pressure during the step in question while $P_w(t_{n-1})$ is the pressure at the beginning of the step in question, $q_n$ is the flow rate for the step in question while $q_{n-1}$ is the flow rate immediately preceding the step in question. Considering now the manner in which Equation 1 is used to generate the values for Step 1, for Step 1 the equation can be written as follows:

$$\frac{P_1(t) - P(t_0)}{q_1 - q_0}$$

Thus, with reference to Table I and Pt. No. 2 as an example, the equation can be written as follows:

$$\frac{1545.70 - 1549.09}{0 - 200} = 1.6941 \times 10^{-2}$$

As can be seen, the value in the last column in Table I under the pressure function heading is $1.6941 \times 10^{-2}$.

The value of the pressure function for each of the remaining pressures for Step 1 can be calculated in the same manner thereby producing the values along the vertical axis in FIG. 2D at which the circles (Step 1 pressure functions) are plotted.

Consideration will now be given to the manner in which the pressure function for Step 2 is generated. During Step 2, Equation 1 can be written as:

$$\frac{P_2(t) - P(t_1)}{q_2 - q_1}$$

For the first pressure measurement in Step 2 (Pt. No. 33 in Table I) the values are as follows:

$$\frac{1191.92 - 1171.58}{1200 - 0} = 1.6949 \times 10^{-2}$$

The remaining pressure function values in Table I are plotted for Step 2 thereby producing the square data points on the plot of FIG. 2D.

Consideration will now be given to the manner in which the normalized or equivalent time value corresponding to each pressure point which is plotted along the horizontal axis is determined. The function for generating the value shown in the equivalent time column in Table I, for radial flow, is as follows:

$$\left[\sum_{j=1}^{n-1}\left(\frac{t_{n-1}-t_{j-1}}{\Delta t+t_{n-1}-t_{j-1}}\right)\left(\frac{q_{j-1}-q_j}{q_n-q_{n-1}}\right)\right]\cdot\Delta t \quad (2)$$

In *A New Method to Account for Producing Time Effects When Drawdown Type Curves are Used to Analyze Pressure Buildup and Other Test Data,* Agarwal, Society of Petroleum Engineers of AIME, SPE 9289, the above equation was shown to account for producing time effects in formations having generally radial low, i.e., no sizable fractures. In other words, the above equation can be used to generate equivalent time values for corresponding real time values that are each related to a pressure value in the formation. By so doing, the pressure effects produced by formation flow in preceding time periods are eliminated from the time period of interest.

Equation (2) is thus used to generate an equivalent time, shown in column 4 of Table I where $q_n$ is the flow rate in the time period of interest, $q_{n-1}$ is the flow start of the flow period of interest and $\Delta t$ is the time between the start of the flow period of interest to the time at which the equivalent time is being determined. One can use Equation (2) to generate the equivalent time values in column 4 of Table I for each of the times in the two flow periods. Thereafter, the pressure function versus equivalent time for each flow period is plotted.

It can be seen in FIG. 2D, the data for the two steps overlay each other up until slightly before $10^0$ or 1 equivalent time hour. This is to be expected for a formation which has not yet fractured. Since the pressures have been normalized and since the time scale has been shifted by the equivalent time function to remove the effect of pressures and rates from preceding injection periods, the data from each period, when superposed, should track one another up until the occurrence of the fracture. When the fracture occurs, in the second period, the data collected for the second period deviate from that collected in the first period as can be seen in FIG. 2D. FIG. 2D can be examined to determine either the equivalent time or the pressure function value where the plots deviate. Thereafter, this value can be referenced to Table I to find the pressure when the plots deviated from one another, which is the formation parting pressure. For example, it can be seen that the value of the time function at the point labeled "Fracture Extension" appears to be approximately 0.7 hour. Examination of Table I identifies 0.71883 equivalent time as the point at which the plots deviate, the pressure occurring at that equivalent time is equal to 1603.62 psi, which is the formation parting pressure for the example under consideration.

Figures 3A, 3B:
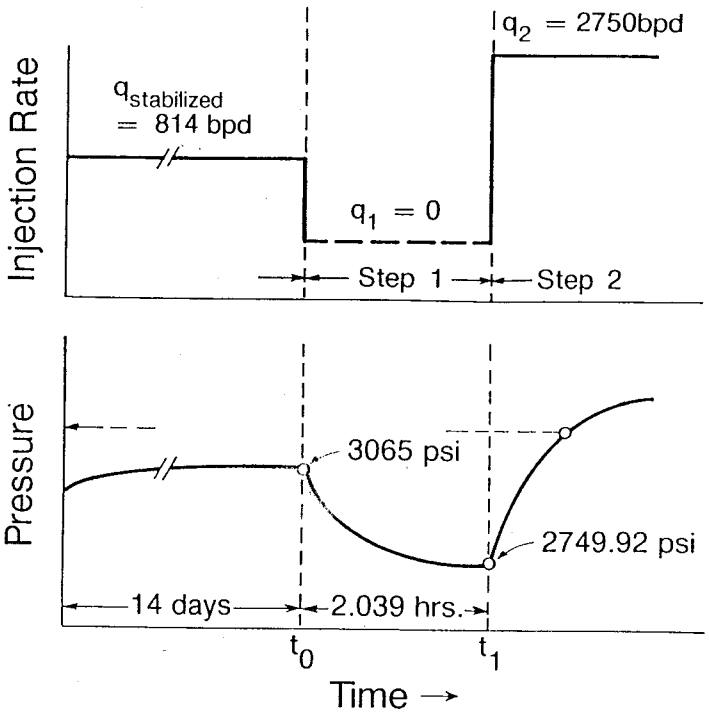
FIG. 3A is a plot of water injection rate vs time utilizing actual field data in Mode I.
FIG. 3B is a plot of pressure vs time utilizing actual field data in Mode I.
Figure 3C:
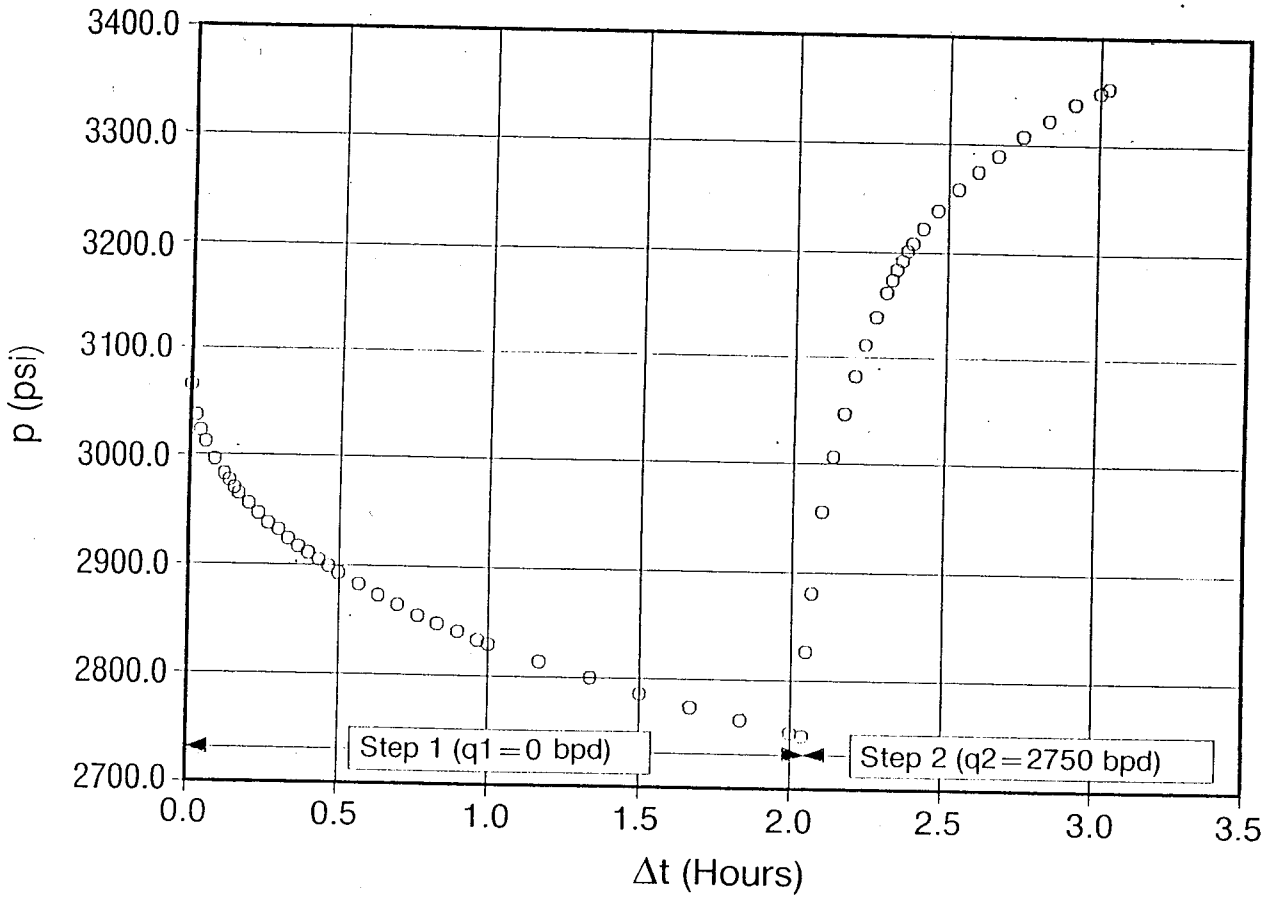
FIG. 3C is an enlarged portion of the plot of FIG. 3B.
Figure 3D:
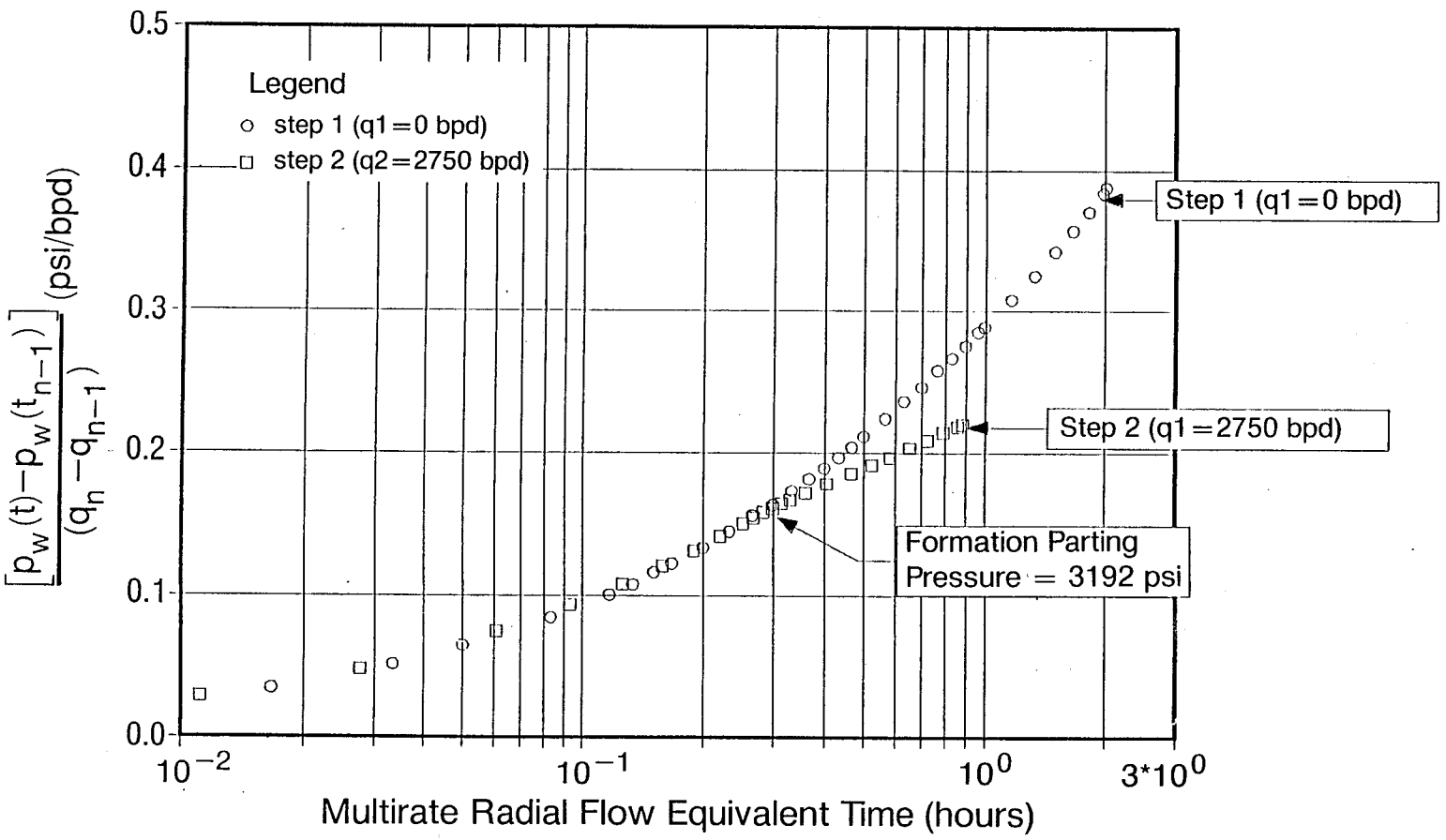
FIG. 3D is a superposed plot of the pressure and time functions for the first and second periods utilizing actual field data in Mode I.

Considering now another example utilizing Mode I of the method of the instant invention, attention is directed to FIGS. 3A–3D and to Table II. The data discussed in this example was collected from an operating water injection well. As can be seen in FIGS. 3A and 3B, the pressure was initially stabilized at an injection rate of 814 barrels per day. It can be seen in FIG. 3B that this prolonged constant rate injection period stabilized the pressure in the well. At $t_0$ (the beginning of the first step) when the wellbore pressure was equal to 3065 psi, the well was shut-in, i.e., the flow rate was set to zero for a period of 2.039 hours. This induced a pressure falloff from 3065 psi to 2749.92 psi, as can be seen in FIG. 3B until time $t_1$ (the beginning of the second step) at which point the rate of injection was changed to 2750 barrels per day thereby increasing the pressure. The field measured pressure data for steps 1 and 2 is shown in FIG. 3C.

As in the preceding example, Equation 1 is used to calculate the pressure function value in Table II and Equation 2 is used to calculate the equivalent time function in Table II. Thereafter, pressure functions vs equivalent times for each step are plotted and superposed over one another to produce the plot of FIG. 3D. Since pressure values are normalized and since the equivalent time function eliminates the prior pressure effects in the period under consideration which were produced as the result of flows in preceding periods, the plots for each step will coincide up until there is a change in the system under consideration, i.e., until the formation fractures. At that point, the plots deviate from one another. Formation parting pressure can be identified as having occurred at approximately 0.3 equivalent time hours. Referring to Table II, there is an equivalent time of 0.29849 hour at which point the real pressure was 3192 psi, which is identified as the formation parting pressure.

Figure 4A:
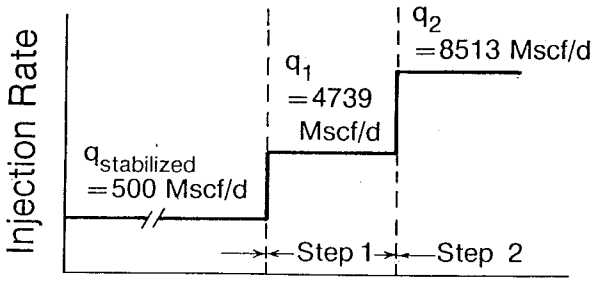
FIG. 4A is a plot of carbon dioxide injection rate vs time utilizing actual field data in Mode II.
Figure 4B:
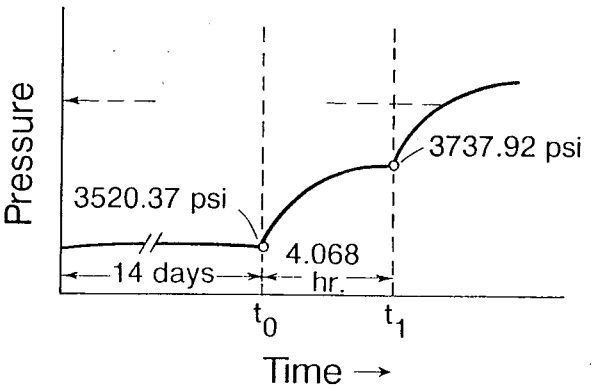
FIG. 4B is a plot of pressure vs time utilizing actual field data in Mode II.
Figure 4C:
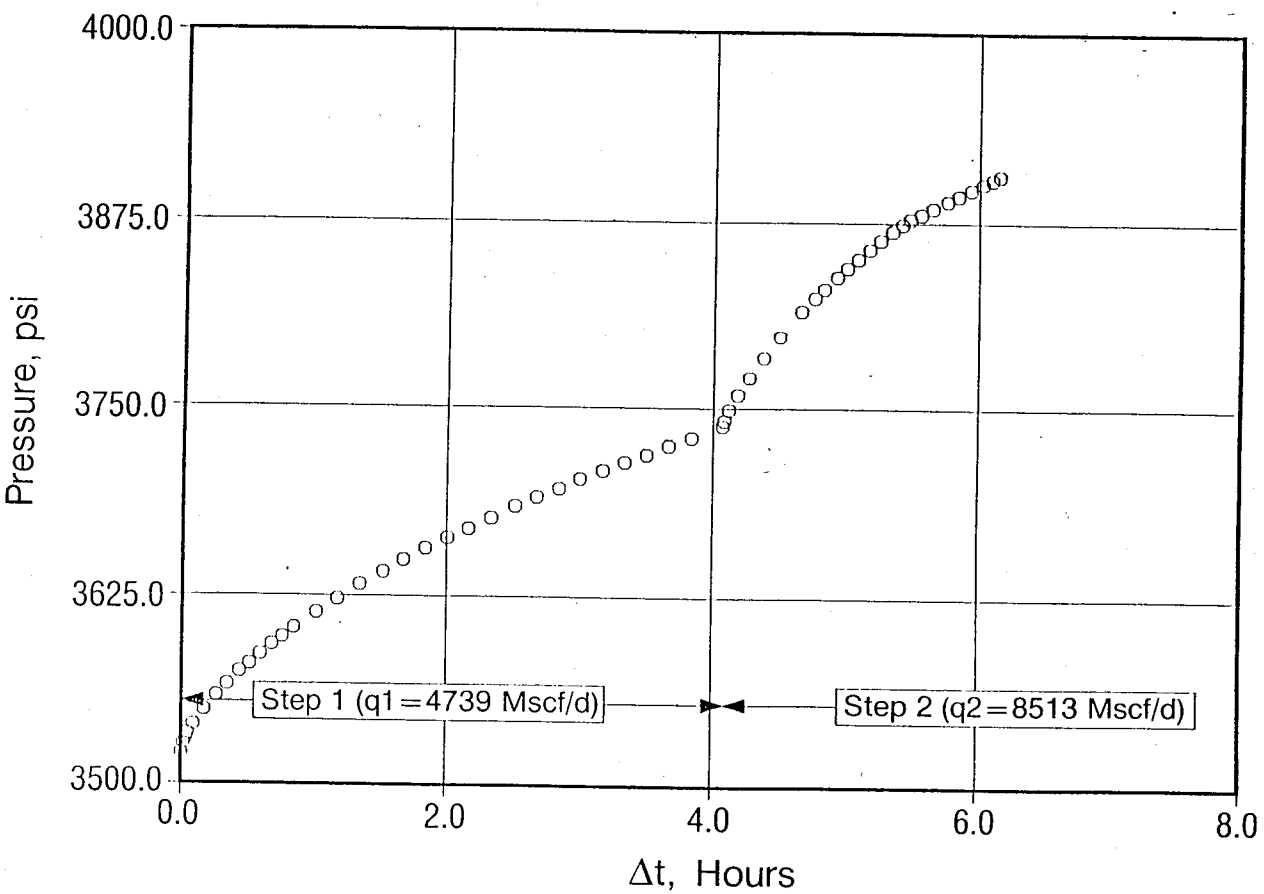
FIG. 4C is an enlarged portion of the plot of FIG. 4B.

Turning now to FIGS. 4A–4D, included herein are plots generated from data obtained utilizing the Mode II method of the instant invention in an operating carbon dioxide injection well which has been fractured. It can be seen, by comparing FIGS. 4A and 4B, that the pressure in the well was stabilized by injecting at a rate of 500 mscf per day. At time $t_0$ (the beginning of the first step), the rate was changed to 4739 mscf per day for a time of 4.068 hours. At $t_1$ (the beginning of the second step) the injection rate was again increased to 8513 mscf per day. FIG. 4C is a plot of the pressure versus real time for the first and second periods, i.e., commencing at $t_0$ in FIG. 4B.

Equation (2) is valid for generally radial flow from the wellbore, i.e., when there is no significant fracture. Another function must be used for generally linear flow, i.e., when a fractured well is being tested. The equation for linear flow equivalent time is as follows:

$$\left[\sum_{j=1}^{n-1}\left(\frac{q_{j-1}-q_j}{q_n-q_{n-1}}\right)\left(\sqrt{t_{n-1}-t_{j-1}}-\sqrt{\Delta t+t_{n-1}-t_{j-1}}\right)\right]+\sqrt{\Delta t} \quad (3)$$

In the above equation, j is an index, $q_n$ is the in the time period of interest, $q_{n-1}$ is the flow flow rate in the preceding period, $t_{n-1}$ is the time at the beginning of the period of interest and $\Delta t$ is the time between the beginning of the period of interest to the time at which linear flow equivalent time is being calculated. In Singh, Agarwal and Krase, *Systematic Design and Analysis of Step Rate Tests to Determine Formation Parting Pressure,* Society of Petroleum Engineers of AIME, SPE 16798, the above equation was shown to account for producing time effects in formations having linear flow, i.e., fractured wells. In other words, Equation (3) can be used to generate equivalent time values for corresponding real time values that are each related to a pressure value in the formation. By so doing, the pressure effects produced by formation flow in preceding time periods are eliminated from the time period of interest.

Figure 4D:
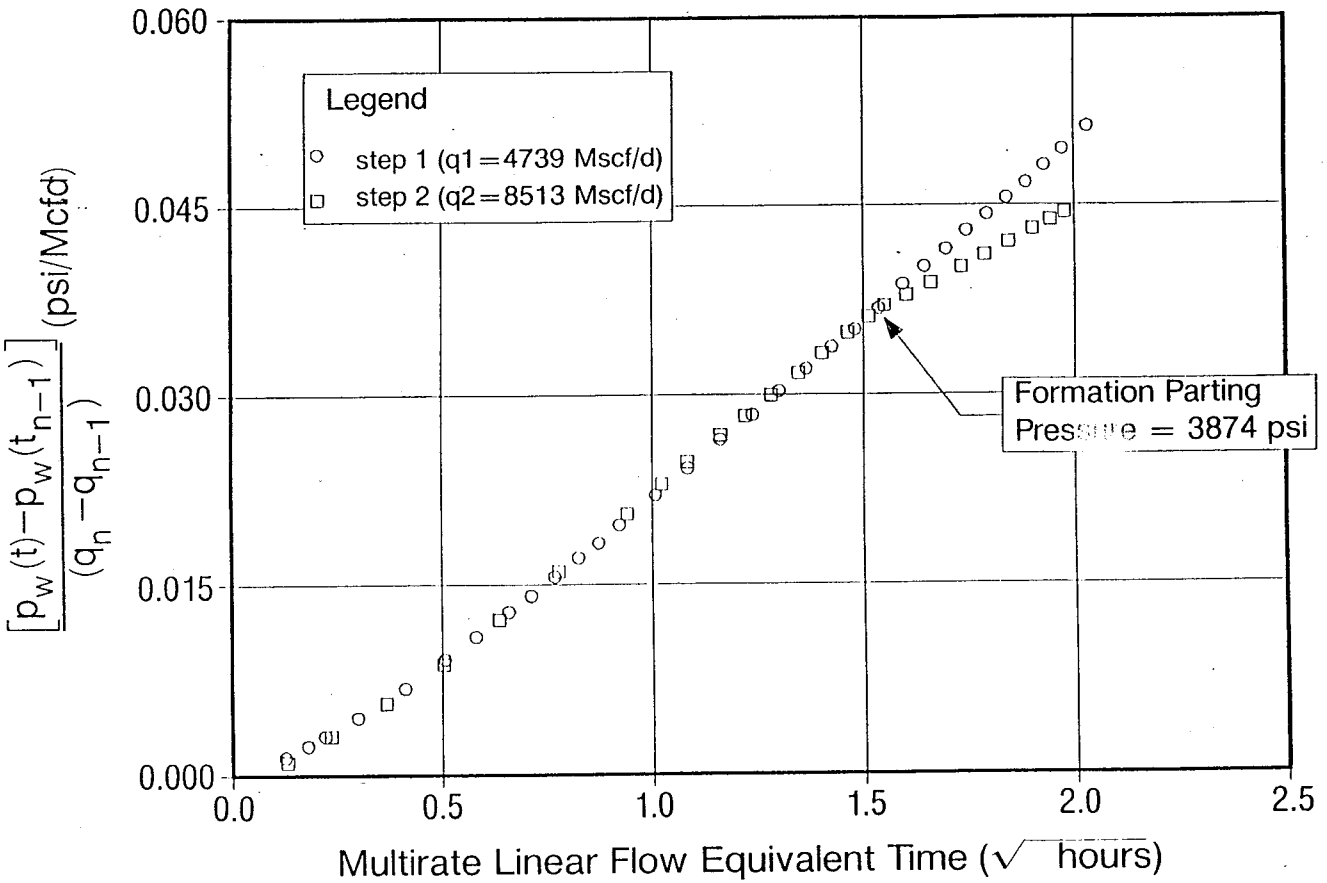
FIG. 4D is a superposed plot of the pressure and time functions for the first and second periods utilizing actual field data in Mode II.

As in the preceding examples, Equation (1) is used to generate the normalized pressure function in Table III; however, the linear flow equivalent time Equation (3) is used to generate the equivalent time function of Table III. When the Table III equivalent time function is plotted versus the pressure function for each time period and the two are superposed, the plot of FIG. 4D is produced. As in the preceding examples, the point at which the plots deviate from one another indicates the formation parting pressure; although, in the case under consideration, it should be noted that the formation is already fractured and the point at which the data deviate from one another is the point at which the pre-existing fracture extends. Relating the point of deviation in FIG. 4D to the values in Table III, the real pressure value at which point the normalized plots deviate from one another is 3874.32 psi, which is the formation parting pressure or, in the instant case, the pressure at which the pre-existing fracture extends.

In yet another mode of carrying out the invention, the formation surrounding an injection well is maintained at a pressure below formation parting pressure. Thereafter, a single constant rate injection is applied which causes the pressure to exceed parting pressure. The pressure is measured before and during the injection and the resulting data is analyzed by existing pressure transient techniques. For example, log-log and semi-log plots of the appropriate pressure and pressure derivative versus time functions will exhibit a decrease in slope on the semi-log plot or decrease in the pressure derivative function when the formation parting pressure is exceeded. The parting pressure corresponds to the point at which this decrease occurs. This mode of carrying out the invention can be more difficult to analyze than that used in connection with FIGS. 2A-2D, 3A-3D and 4A-4D since there is no base line to define formation pressure response when the fracture does not occur as in the case of the data plotted for the first step in a two-step test. This difficulty is especially pronounced for fractured wells or when wellbore storage effects are large. However, this method of carrying out the invention is suitable for use in connection with unfractured wells with minimal wellbore storage.

If in carrying out the invention it is suspected, e.g., in the second step of a two-step test, that formation parting pressure has not been exceeded, a third step can be added which again increases the injection flow rate. Thereafter, the second and third steps can be analyzed as described above as if they were the first and second steps in order to determine formation parting pressure.

It can thus be seen that the instant invention comprises improvement over previous multi-rate step tests by shortening the amount of time needed to carry out the test and by increasing testing accuracy. The test can be readily conducted on a well which is shut-in by injecting fluid at a first rate below formation pressure and thereafter increasing to a second rate (Mode IV). Alternatively, on a well which is stabilized at a preselected flow rate, the pressure can be increased to a first rate in the first step and thereafter again increased to a second rate in the second step (Mode II). In some cases, the stabilized injection flow rate can be high enough that two additional rate (and therefore pressure) increases in the formation would not be desirable. In such cases, the invention can be carried out by shutting in the well as the first step (Mode I) or by reducing the injection rate as the first step (Mode III) and thereafter injecting fluid in the second step at a rate which causes formation pressure to rise above parting pressure.

The length of time for the first and second steps should be such that the first step provides enough base line data on an equivalent time scale for comparison of data collected during the second step. In other words, if the equivalent time for the end of the first step is smaller than the equivalent time, for the end of tee second step, and parting pressure is exceeded during the second step beyond the first step equivalent time, then determination of parting pressure is difficult since there is no base line data (first step data) when the parting pressure is exceeded. Generally speaking, if the first step consists of a pressure falloff, i.e., the rate of injection from the stabilized rate is decreased (Modes I and III), equal time size for the first and second steps is adequate. If the mode of carrying out the invention is used wherein injection rate is increased for each of the steps (Modes II and IV), the first step should be twice as long as the second step. For a specific test, these times can be estimated a priori using the proposed injection rates and injection times in the equivalent time equations.

It is to be appreciated that modifications and additions may be made to the various preferred modes of carrying out the invention while not departing from the spirit thereof, which is defined in the following claims.

TABLE I

| | Simulated Injection Well | | | |
|---|---|---|---|---|
| Pt. No. | Time (hours) | Pressure (psi) | Equivalent Time (hours) | Pressure Function (psi/bpd) |
| Pre-test stabilized rate = 200 bpd, pressure = 1549.09 psi: | | | | |
| 1 | 0.0000E+00 | 1549.09 | 0.0000E+00 | 0.0000E+00 |
| Step 1 (rate = 0, shut-in): | | | | |
| 2 | 5.0000E−03 | 1545.70 | 5.0000E−03 | 1.6941E−02 |
| 3 | 1.0000E−02 | 1543.27 | 1.0000E−02 | 2.9110E−02 |
| 4 | 1.4000E−02 | 1541.28 | 1.4000E−02 | 3.9026E−02 |
| 5 | 4.8000E−02 | 1532.44 | 4.7999E−02 | 8.3246E−02 |
| 6 | 0.1440 | 1517.80 | 1.4399E−01 | 1.5643E−01 |
| 7 | 0.2880 | 1503.20 | 2.8798E−01 | 2.2944E−01 |
| 8 | 0.4320 | 1492.35 | 4.3194E−01 | 2.8367E−01 |
| 9 | 0.7200 | 1476.67 | 7.1985E−01 | 3.6212E−01 |
| 10 | 1.080 | 1461.24 | 1.0797E+00 | 4.3923E−01 |
| 11 | 1.440 | 1448.88 | 1.4394E+00 | 5.0106E−01 |
| 12 | 1.800 | 1438.22 | 1.7990E+00 | 5.5435E−01 |
| 13 | 2.160 | 1429.19 | 2.1586E+00 | 5.9949E−01 |
| 14 | 2.640 | 1418.23 | 2.6379E+00 | 6.5431E−01 |
| 15 | 3.360 | 1404.51 | 3.3566E+00 | 7.2291E−01 |
| 16 | 4.080 | 1392.78 | 4.0750E+00 | 7.8153E−01 |
| 17 | 4.800 | 1382.46 | 4.7931E+00 | 8.3317E−01 |
| 18 | 5.520 | 1373.19 | 5.5109E+00 | 8.7949E−01 |
| 19 | 6.240 | 1364.71 | 6.2283E+00 | 9.2188E−01 |
| 20 | 6.960 | 1357.07 | 6.9455E+00 | 9.6010E−01 |
| 21 | 8.160 | 1344.78 | 8.1401E+00 | 1.0215E+00 |
| 22 | 9.600 | 1333.46 | 9.5725E+00 | 1.0781E+00 |
| 23 | 11.04 | 1322.76 | 1.1004E+01 | 1.1316E+00 |
| 24 | 13.20 | 1308.28 | 1.3148E+01 | 1.2040E+00 |
| 25 | 16.80 | 1289.72 | 1.6716E+01 | 1.2968E+00 |
| 26 | 20.40 | 1273.87 | 2.0276E+01 | 1.3761E+00 |
| 27 | 24.00 | 1259.91 | 2.3829E+01 | 1.4439E+00 |
| 28 | 31.20 | 1239.33 | 3.0911E+01 | 1.5488E+00 |
| 29 | 38.40 | 1218.79 | 3.7963E+01 | 1.6515E+00 |
| 30 | 45.60 | 1208.79 | 4.4985E+01 | 1.7015E+00 |
| 31 | 57.60 | 1191.91 | 5.6622E+01 | 1.7859E+00 |
| 32 | 72.00 | 1171.58 | 7.0479E+01 | 1.8876E+00 |
| Step 2 (rate = 1200 bpd): | | | | |
| 33 | 72.01 | 1191.92 | 5.0048E−03 | 1.6949E−02 |
| 34 | 72.01 | 1206.53 | 9.0025E−03 | 2.9124E−02 |
| 35 | 72.01 | 1218.43 | 1.4007E−02 | 3.9043E−02 |
| 36 | 72.05 | 1271.54 | 4.7999E−02 | 8.3303E−02 |
| 37 | 72.14 | 1359.47 | 1.4395E−01 | 1.5658E−01 |
| 38 | 72.29 | 1444.45 | 2.8781E−01 | 2.2739E−01 |
| 39 | 72.43 | 1508.15 | 4.3159E−01 | 2.8048E−01 |

TABLE I-continued

| Pt. No. | Time (hours) | Simulated Injection Well Pressure (psi) | Equivalent Time (hours) | Pressure Function (psi/bpd) |
|---|---|---|---|---|
| 40 | 72.72 | 1603.62 | 7.1883E−01 | 3.6003E−01 * |
| 41 | 72.72 | 1596.16 | 7.2361E−01 | 3.5382E−01 |
| 42 | 72.74 | 1595.75 | 7.3797E−01 | 3.5348E−01 |
| 43 | 72.79 | 1606.39 | 7.9060E−01 | 3.6234E−01 |
| 44 | 72.82 | 1611.60 | 8.1450E−01 | 3.6669E−01 |
| 45 | 72.82 | 1603.25 | 8.1928E−01 | 3.5973E−01 |
| 46 | 72.84 | 1601.87 | 8.3364E−01 | 3.5858E−01 |
| 47 | 72.86 | 1605.84 | 8.6232E−01 | 3.6189E−01 |
| 48 | 72.91 | 1614.02 | 9.1013E−01 | 3.6870E−01 |
| 49 | 72.92 | 1605.74 | 9.1490E−01 | 3.6180E−01 |
| 50 | 72.93 | 1604.16 | 9.2925E−01 | 3.6049E−01 |
| 51 | 72.96 | 1607.41 | 9.5793E−01 | 3.6319E−01 |
| 52 | 73.01 | 1614.52 | 1.0057E+00 | 3.6912E−01 |
| 53 | 73.15 | 1637.84 | 1.1490E+00 | 3.8855E−01 |
| 54 | 73.30 | 1661.23 | 1.2922E+00 | 4.0804E−01 |
| 55 | 73.51 | 1694.83 | 1.5069E+00 | 4.3604E−01 |
| 56 | 73.87 | 1745.83 | 1.8642E+00 | 4.7854E−01 |
| 57 | 74.23 | 1790.93 | 2.2209E+00 | 5.1613E−01 |
| 58 | 74.83 | 1857.76 | 2.8142E+00 | 5.7182E−01 |
| 59 | 75.31 | 1904.97 | 3.2878E+00 | 6.1116E−01 |

*Formation Parting Pressure

TABLE II

| Pt. No. | Time (hours) | Field Water Injection Well Pressure (psi) | Equivalent Time (hours) | Pressure Function (psi/bpd) |
|---|---|---|---|---|
| Pre-test stabilized rate = 814 bpd, pressure = 3065 psi: | | | | |
| 1 | 0.0000E+00 | 3065.00 | 0.0000E+00 | 0.0000E+00 |
| Step 1 (rate = 0, shut-in): | | | | |
| 2 | 1.6667E−02 | 3037.00 | 1.6665E−02 | 3.4398E−02 |
| 3 | 3.3333E−02 | 3023.00 | 3.3327E−02 | 5.1597E−02 |
| 4 | 5.0000E−02 | 3012.00 | 4.9985E−02 | 6.5111E−02 |
| 5 | 8.3333E−02 | 2996.00 | 8.3292E−02 | 8.4767E−02 |
| 6 | 0.1167 | 2983.00 | 1.1659E−01 | 1.0074E−01 |
| 7 | 0.1333 | 2977.00 | 1.3323E−01 | 1.0811E−01 |
| 8 | 0.1500 | 2970.00 | 1.4987E−01 | 1.1671E−01 |
| 9 | 0.1667 | 2965.00 | 1.6650E−01 | 1.2285E−01 |
| 10 | 0.2000 | 2956.00 | 1.9976E−00 | 1.3391E−01 |
| 11 | 0.2333 | 2947.00 | 2.3301E−00 | 1.4496E−01 |
| 12 | 0.2667 | 2938.00 | 2.6624E−00 | 1.5602E−01 |
| 13 | 0.3000 | 2932.00 | 2.9947E−00 | 1.6339E−01 |
| 14 | 0.3333 | 2924.00 | 3.3267E−00 | 1.7322E−01 |
| 15 | 0.3667 | 2917.00 | 3.6587E−00 | 1.8182E−01 |
| 16 | 0.4000 | 2911.00 | 3.9905E−00 | 1.8919E−01 |
| 17 | 0.4333 | 2905.00 | 4.3222E−00 | 1.9656E−01 |
| 18 | 0.4667 | 2899.00 | 4.6537E−00 | 2.0393E−01 |
| 19 | 0.5000 | 2893.00 | 4.9852E−00 | 2.1130E−01 |
| 20 | 0.5667 | 2883.00 | 5.6476E−00 | 2.2359E−01 |
| 21 | 0.6333 | 2873.00 | 6.3095E−00 | 2.3587E−01 |
| 22 | 0.7000 | 2865.00 | 6.9709E−00 | 2.4570E−01 |
| 23 | 0.7667 | 2855.00 | 7.6318E−01 | 2.5799E−01 |
| 24 | 0.8333 | 2848.00 | 8.2922E−01 | 2.6658E−01 |
| 25 | 0.9000 | 2841.00 | 8.9520E+01 | 2.7518E−01 |
| 26 | 0.9667 | 2833.00 | 9.6114E+01 | 2.8501E−01 |
| 27 | 1.000 | 2830.00 | 9.9408E+01 | 2.8870E−01 |
| 28 | 1.167 | 2814.00 | 1.1586E+00 | 3.0835E−01 |
| 29 | 1.333 | 2800.00 | 1.3228E+00 | 3.2555E−01 |
| 30 | 1.500 | 2786.00 | 1.4867E+00 | 3.4275E−01 |
| 31 | 1.667 | 2774.00 | 1.6503E+00 | 3.5749E−01 |
| 32 | 1.833 | 2763.00 | 1.8135E+00 | 3.7101E−01 |
| 33 | 2.000 | 2752.00 | 1.9765E−00 | 3.8452E−01 |
| 34 | 2.039 | 2749.00 | 2.0144E−00 | 3.8821E−01 |
| Step 2 (rate = 2750 bpd): | | | | |
| 35 | 2.050 | 2827.00 | 1.1117E−02 | 2.8364E−02 |
| 36 | 2.067 | 2881.00 | 2.7692E−02 | 4.8000E−02 |
| 37 | 2.100 | 2956.00 | 6.0610E−02 | 7.5273E−02 |
| 38 | 2.133 | 3007.00 | 9.3227E−02 | 9.3818E−02 |
| 39 | 2.167 | 3047.00 | 1.2555E−01 | 1.0836E−01 |
| 40 | 2.200 | 3082.00 | 1.5759E−01 | 1.2109E−01 |
| 41 | 2.233 | 3112.00 | 1.8936E−01 | 1.3200E−01 |
| 42 | 2.267 | 3139.00 | 1.8936E−01 | 1.4182E−01 |

TABLE II-continued

| Pt. No. | Time (hours) | Field Water Injection Well Pressure (psi) | Equivalent Time (hours) | Pressure Function (psi/bpd) |
|---|---|---|---|---|
| 43 | 2.300 | 3162.00 | 2.5210E−01 | 1.5018E−01 |
| 44 | 2.317 | 3174.00 | 2.6762E−01 | 1.5455E−01 |
| 45 | 2.333 | 3184.00 | 2.8309E−01 | 1.5818E−01 |
| 46 | 2.350 | 3192.00 | 2.9849E−01 | 1.6109E−01 * |
| 47 | 2.367 | 3201.00 | 3.1383E−01 | 1.6436E−01 |
| 48 | 2.383 | 3208.00 | 3.2911E−01 | 1.6691E−01 |
| 49 | 2.417 | 3222.00 | 3.5950E−01 | 1.7200E−01 |
| 50 | 2.467 | 3239.00 | 4.0465E−01 | 1.7818E−01 |
| 51 | 2.533 | 3259.00 | 4.6409E−01 | 1.8545E−01 |
| 52 | 2.600 | 3275.00 | 5.2268E−01 | 1.9127E−01 |
| 53 | 2.667 | 3290.00 | 5.8048E−01 | 1.9673E−01 |
| 54 | 2.750 | 3308.00 | 6.5167E−01 | 2.0327E−01 |
| 55 | 2.833 | 3323.00 | 7.2173E−01 | 2.0873E−01 |
| 56 | 2.917 | 3338.00 | 7.9074E−01 | 2.1418E−01 |
| 57 | 3.000 | 3349.00 | 8.5874E−01 | 2.1818E−01 |
| 58 | 3.028 | 3353.00 | 8.8119E−01 | 2.1964E−01 |

*Formation Parting Pressure

TABLE III

| Pt. No. | Time (hours) | Field $CO_2$ Injection Well Pressure (psi) | Equivalent Time (hours)[1] | Pressure Function (psi/Mscfd) |
|---|---|---|---|---|
| Pre-test stabilized rate = 500 Mscf/d, pressure = 3520.37 psi: | | | | |
| 1 | 0.0000E+00 | 3520.37 | 0.0000E−00 | 0.0000E+00 |
| Step 1 (rate = 4739, MSCF/d): | | | | |
| 2 | 1.6000E−02 | 3526.34 | 1.2654E−01 | 1.4083E−03 |
| 3 | 3.2000E−02 | 3530.05 | 1.7899E−01 | 2.2835E−03 |
| 4 | 4.8000E−02 | 3533.31 | 2.1925E−01 | 3.0526E−03 |
| 5 | 8.8000E−02 | 3539.46 | 2.9694E−01 | 4.5034E−03 |
| 6 | 0.1680 | 3549.27 | 4.1044E−01 | 6.8176E−03 |
| 7 | 0.2560 | 3558.96 | 5.0682E−01 | 9.1035E−03 |
| 8 | 0.3360 | 3566.65 | 5.8076E−01 | 1.0918E−02 |
| 9 | 0.4320 | 3574.97 | 6.5870E−01 | 1.2880E−02 |
| 10 | 0.5040 | 3580.31 | 7.1160E−01 | 1.4140E−02 |
| 11 | 0.5840 | 3586.66 | 7.6614E−01 | 1.5638E−02 |
| 12 | 0.6720 | 3593.00 | 8.2199E−01 | 1.7134E−02 |
| 13 | 0.7520 | 3597.97 | 8.6968E−01 | 1.8306E−02 |
| 14 | 0.8400 | 3604.09 | 9.1931E−01 | 1.9750E−02 |
| 15 | 1.008 | 3614.10 | 1.0073E+00 | 2.2111E−02 |
| 16 | 1.168 | 3623.11 | 1.0846E+00 | 2.4237E−02 |
| 17 | 1.336 | 3632.64 | 1.1603E+00 | 2.6485E−02 |
| 18 | 1.512 | 3640.93 | 1.2347E+00 | 2.8441E−02 |
| 19 | 1.672 | 3648.77 | 1.2986E+00 | 3.0290E−02 |
| 20 | 1.840 | 3656.21 | 1.3626E+00 | 3.2045E−02 |
| 21 | 2.008 | 3663.49 | 1.4237E+00 | 3.3763E−02 |
| 22 | 2.168 | 3669.35 | 1.4796E+00 | 3.5145E−02 |
| 23 | 2.336 | 3676.47 | 1.5362E+00 | 3.6825E−02 |
| 24 | 2.512 | 3684.42 | 1.5933E+00 | 3.8700E−02 |
| 25 | 2.672 | 3690.35 | 1.6435E+00 | 4.0099E−02 |
| 26 | 2.840 | 3696.22 | 1.6947E+00 | 4.1484E−02 |
| 27 | 3.000 | 3702.52 | 1.7420E+00 | 4.2970E−02 |
| 28 | 3.168 | 3708.03 | 1.7904E+00 | 4.4270E−02 |
| 29 | 3.336 | 3713.56 | 1.8376E+00 | 4.5574E−02 |
| 30 | 3.504 | 3718.74 | 1.8836E+00 | 4.6796E−02 |
| 31 | 3.672 | 3724.55 | 1.9285E+00 | 4.8167E−02 |
| 32 | 3.840 | 3730.08 | 1.9724E+00 | 4.9472E−02 |
| 33 | 4.068 | 3737.92 | 2.0305E+00 | 5.1321E−02 |
| Step 2 (rate = 8513 MSCF/d): | | | | |
| 34 | 4.084 | 3741.70 | 1.3074E−01 | 1.0016E−03 |
| 35 | 4.116 | 3749.33 | 2.3244E−01 | 3.0234E−03 |
| 36 | 4.180 | 3759.14 | 3.6599E−01 | 5.6227E−03 |
| 37 | 4.268 | 3770.81 | 5.0293E−01 | 8.7149E−03 |
| 38 | 4.372 | 3784.14 | 6.3558E−01 | 1.2247E−02 |
| 39 | 4.500 | 3798.57 | 7.7611E−01 | 1.6071E−02 |
| 40 | 4.668 | 3815.85 | 9.3814E−01 | 2.0649E−02 |
| 41 | 4.764 | 3824.66 | 1.0230E+00 | 2.2984E−02 |
| 42 | 4.836 | 3831.12 | 1.0838E+00 | 2.4695E−02 |
| 43 | 4.932 | 3839.07 | 1.1617E+00 | 2.6802E−02 |
| 44 | 5.004 | 3844.81 | 1.2181E+00 | 2.8323E−02 |
| 45 | 5.084 | 3850.97 | 1.2789E+00 | 2.9955E−02 |
| 46 | 5.172 | 3857.59 | 1.3438E+00 | 3.1709E−02 |

TABLE III-continued

| Pt. No. | Time (hours) | Field $CO_2$ Injection Well Pressure (psi) | Equivalent Time (hours)$^{\frac{1}{2}}$ | Pressure Function (psi/Mscfd) |
|---|---|---|---|---|
| 47 | 5.252 | 3863.43 | 1.4012E+00 | 3.3256E−02 |
| 48 | 5.340 | 3869.56 | 1.4627E+00 | 3.4881E−02 |
| 49 | 5.412 | 3874.32 | 1.5119E+00 | 3.6142E−02 * |
| 50 | 5.468 | 3877.69 | 1.5495E+00 | 3.7035E−02 |
| 51 | 5.548 | 3880.76 | 1.6023E+00 | 3.7848E−02 |
| 52 | 5.636 | 3884.48 | 1.6592E+00 | 3.8834E−02 |
| 53 | 5.748 | 3889.14 | 1.7299E+00 | 4.0069E−02 |
| 54 | 5.836 | 3892.82 | 1.7843E+00 | 4.1044E−02 |
| 55 | 5.932 | 3896.68 | 1.8425E+00 | 4.2067E−02 |
| 56 | 6.028 | 3900.44 | 1.8996E+00 | 4.3063E−02 |
| 57 | 6.100 | 3903.15 | 1.9418E+00 | 4.3781E−02 |
| 58 | 6.160 | 3905.55 | 1.9765E+00 | 4.4417E−02 |

*Fracture Extension Pressure

What is claimed is:

1. A method for determining the parting pressure of a formation having a wellbore therethrough comprising the steps of:

establishing a first rate at which fluid is injected into the wellbore;

injecting fluid into the wellbore at the first rate of injection for a first time period;

changing the rate of injection to a second rate which causes the formation pressure to rise above the formation parting pressure;

injecting fluid into the wellbore at the second rate of injection for a second time period;

measuring the pressure of the formation ring the periods of the first and second rates of injection;

normalizing the pressure data obtained during said first time period;

normalizing the pressure data obtained during said second time period; and determining the formation parting pressure by locating the point at which the normalized data for said second time period deviate from the normalized data for said first time period.

2. The method of claim 1 wherein said method further comprises the step of stabilizing formation pressure prior to the step of establishing a first rate at which fluid is injected into the wellbore.

3. The method of claim 1 wherein the step of stabilizing formation pressure comprises the step of shutting in the well.

4. The method of claim 1 wherein the step of stabilizing formation pressure comprises the steps of:

establishing a fixed rate at which fluid is injected into the wellbore; and injecting fluid into the wellbore at the established rate of injection for a time sufficient to stabilize formation pressure.

5. The method of claim 1 wherein the steps of establishing a first rate at which fluid is injected into the wellbore and injecting fluid into the wellbore at the first rate of injection for a first time period comprise the step of shutting in the well for a first time period.

6. The method of claim 2 wherein the step of normalizing the pressure data obtained during the first time period comprises the step of subtracting the wellbore pressure at the beginning of said first time period from wellbore pressure samples obtained during the first time period to produce a series of differential pressures.

7. The method of claim 6 wherein the step of normalizing the pressure data obtained during the first time period further comprises the step of dividing each differential pressure by the difference in flow rate between the first period and the flow rate after stabilizing formation pressure and prior to the first period to produce a series of flow-normalized differential pressures.

8. The method of claim 7 wherein the step of normalizing the pressure data obtained during the first time period further comprises the step of relating each flow-normalized differential pressure to an equivalent time thereby substantially eliminating the effect on the data obtained in said first time period of wellbore pressure occurring in said first time period as a result of injection of fluid into said wellbore prior to the beginning of said first time period.

9. The method of claim 8 wherein said method further comprises the step of plotting each flow-normalized pressure differential against its associated equivalent time thereby providing a normalized pressure plot for said first time period.

10. The method of claim 9 wherein the step of normalizing tee pressure data obtained during second time period comprises the step of generating a normalized pressure plot for said second time period in substantially the same manner as said normalized pressure plot is generated for said first time period.

11. The method of claim 10 wherein said method further comprises the step of superposing said normalized pressure plots and locating the equivalent time at which said plots diverge from one another.

12. The method of claim 11 wherein said method further comprises the steps of:

converting the equivalent time at which said plots diverge from one another to a real time value; and determining the value of the wellbore pressure at said real time value.

13. A method for determining the parting pressure of a formation having a wellbore therethrough comprising the steps of:

stabilizing the formation pressure;

establishing a first rate at which fluid is injected into the wellbore;

injecting fluid into the wellbore at the first rate of injection for a first time period;

changing the rate of injection to a second rate which causes the formation pressure to rise above the formation parting pressure;

injecting fluid into the wellbore at the second rate of injection for a second time period;

measuring wellbore pressure during said first and second periods;

generating a first pressure function defined by the formula $(p_1(t)-p(t_0))/(\Delta Q_1)$, wherein $p_1(t)$ is the wellbore pressure during the first time period, $p(t_0)$ is the wellbore pressure at the start of the first time period and $\Delta Q_1$ is the difference in flow rate between the first time period and the flow rate after stabilizing formation pressure and prior to the first period;

generating a second pressure function defined by the formula $(p_2(t)-p(t_1))/(\Delta Q_2)$, wherein $p_2(t)$ is the wellbore pressure during the second time period, $p(t_2)$ is the wellbore pressure at the start of the second time period and $\Delta Q_2$ is the difference in flow rates between the first and second time periods;

changing the time scale to which said first pressure function is related in order to remove from said first pressure function substantially all pressure effects produced by flow in said wellbore prior to said first period;

changing the time scale to which said second pressure function is related in order to remove from said second pressure function substantially all pressure effects produced by flow in said wellbore prior to said second period;

superposing said first and second pressure functions;

locating the point at which said first and second pressure functions diverge from one another;

determining the time at which such divergence occurs; and identifying the wellbore pressure at the time so determined as the formation parting pressure.

14. The method of claim 13 wherein the step of stabilizing the formation pressure comprises the steps of:

establishing a fixed rate at which fluid is injecting fluid into the wellbore at the established rate of injection for a time sufficient to stabilize formation pressure.

15. The method of claim 14 wherein the steps of establishing a fixed rate at which fluid is injected into the wellbore and injecting fluid into the wellbore at the fixed rate of injection for a first time period comprise the step of shutting in the well for a selected time periods.

16. A method for detecting the parting pressure of a formation having a wellbore therethrough comprising the steps of:

stabilizing the formation pressure by injecting fluid into the well at a selected rate;

shutting in the well for a first period of establishing a rate of injection which causes the formation pressure to rise above the formation parting pressure;

injecting fluid into the wellbore at the second rate of injection for a second time period;

measuring the pressure in the wellbore during the first and second periods of time;

normalizing the pressure data obtained during said first time period;

normalizing the pressure data obtained during said second time period; and determining the formation parting pressure by locating the point at which the normalized data for said first time period deviate from the normalized data for said second time period.

17. A method for determining the parting pressure of a formation having a wellbore therethrough comprising the steps of:

(a) establishing a pressure in the formation which is below parting pressure;

(b) injecting fluid into the well at a rate which causes the formation pressure to rise above parting pressure;

measuring formation pressure during steps (a) and (b) and (c) locating the pressure at which the rate of pressure change decreases to determine the parting pressure of the formation.

* * * * *

UNITED STATES PATENT AND TRADEMARK OFFICE

CERTIFICATE OF CORRECTION

PATENT NO. : 4,793,413

DATED : December 27, 1988

INVENTOR(S) : Singh, et al.

It is certified that error appears in the above—identified patent and that said Letters Patent is hereby corrected as shown below:

Column 1, line 5 "1. Field of the Invention" should be on line 6 all by itself.

Column 1, line 11 "2. Setting of the Invention" should be on line 12 all by itself.

Column 5, in the equation, line 2 "Σ" should be --π--.

Column 5, line 12 "low" should be --flow--.

Column 5, line 22 after "flow" insert --rate in the preceding time period, $t_{n-1}$ is the time at the--.

Column 6, line 55 delete the second "flow".

Column 8, line 9 "tee" should be --the--.

Claim 1, column 11, line 32 "ring" should be --during--.

Claim 10, column 12, line 21 "tee" should be --the--.

Claim 14, column 13, line 19 after "is" insert --injected into the wellbore; and--.

Claim 15, column 13, line 26 "periods" should be --period--.

UNITED STATES PATENT AND TRADEMARK OFFICE

CERTIFICATE OF CORRECTION

PATENT NO. : 4,793,413

DATED : December 27, 1988

INVENTOR(S) : Singh, et al

It is certified that error appears in the above-identified patent and that said Letters Patent is hereby corrected as shown below:

Claim 16, column 14, line 3 after "period of" insert --time;--.

Signed and Sealed this

Twenty-seventh Day of March, 1990

*Attest:*

JEFFREY M. SAMUELS

*Attesting Officer*

*Acting Commissioner of Patents and Trademarks*